US011180937B2

(12) United States Patent
Kim et al.

(10) Patent No.: US 11,180,937 B2
(45) Date of Patent: Nov. 23, 2021

(54) HOOD LATCH DEVICE FOR VEHICLE

(71) Applicants: Hyundai Motor Company, Seoul (KR); Kia Motors Corporation, Seoul (KR); Pyeong Hwa Automotive Co., Ltd., Daegu (KR)

(72) Inventors: Sang Il Kim, Hwaseong-si (KR); Hyun Duk Cho, Daegu (KR)

(73) Assignees: Hyundai Motor Company, Seoul (KR); Kia Motors Corporation, Seoul (KR); Pyeong Hwa Automotive Co., Ltd., Daegu (KR)

( * ) Notice: Subject to any disclaimer, the term of this patent is extended or adjusted under 35 U.S.C. 154(b) by 714 days.

(21) Appl. No.: 16/009,639

(22) Filed: Jun. 15, 2018

(65) Prior Publication Data

US 2019/0249468 A1 Aug. 15, 2019

(30) Foreign Application Priority Data

Feb. 14, 2018 (KR) ..... 10-2018-0018391

(51) Int. Cl.
*E05B 81/20* (2014.01)
*E05B 81/56* (2014.01)
(Continued)

(52) U.S. Cl.
CPC ..... *E05B 81/20* (2013.01); *E05B 81/16* (2013.01); *E05B 81/56* (2013.01); *E05B 83/24* (2013.01)

(58) Field of Classification Search
CPC ..... E05B 81/20; E05B 81/16; E05B 81/56; E05B 81/34; E05B 83/24; E05B 58/26;
(Continued)

(56) References Cited

U.S. PATENT DOCUMENTS 4,763,936 A * 8/1988 Rogakos ..... E05B 81/14 292/201
2015/0308163 A1 10/2015 Tomaszewski
(Continued)

FOREIGN PATENT DOCUMENTS

JP 2017-190636 A 10/2017
KR 10-2006-0018355 A 3/2006
(Continued)

*Primary Examiner* — Kristina R Fulton
*Assistant Examiner* — Yahya I Sidky
(74) *Attorney, Agent, or Firm* — Morgan, Lewis & Bockius LLP

(57) ABSTRACT

A hood latch device may include a base having therein an insertion recess to receive a striker, a claw lever rotatably mounted to the base, the claw lever rotatable by the striker inserted into the insertion recess to surround and restrict the striker, a pawl lever rotatably mounted to a portion of the base, the pawl lever to restrict a rotation of the claw lever so that a rotational position of the claw lever corresponds to one of a first-stage locking state and a second-stage locking state depending on a contact position with the claw lever, a release lever rotatably mounted to the pawl lever to be rotated with the pawl lever, and an operating mechanism mounted to the base, the operating mechanism including a lever-rotating device to be rotated by receiving torque from a driving motor and to selectively rotate one of the claw lever and the pawl lever.

16 Claims, 8 Drawing Sheets

(51) Int. Cl.
*E05B 83/24* (2014.01)
*E05B 81/16* (2014.01)

(58) Field of Classification Search
CPC ..... B62D 25/10; B62D 25/105; B62D 25/12; Y10S 292/14; Y10S 292/23; Y10S 292/25; Y10S 292/34; Y10S 292/42; Y10S 292/1047; Y10S 292/1079; Y10S 292/1082; Y10T 292/1047; Y10T 292/1079; Y10T 292/1082
USPC ..... 296/193.11
See application file for complete search history.

(56) References Cited

U.S. PATENT DOCUMENTS

| | | | |
|---|---|---|---|
| 2017/0306661 | A1 | 10/2017 | Kim et al. |
| 2018/0073283 | A1 | 3/2018 | Kim et al. |

FOREIGN PATENT DOCUMENTS

| | | | | | |
|---|---|---|---|---|---|
| KR | 10-1273515 | B1 | | 6/2013 | |
| KR | 101541251 | B1 | * | 8/2015 | |
| KR | 10-2016-0041189 | A | | 4/2016 | |
| KR | 20160041189 | | * | 4/2016 | |
| WO | WO 03/006769 | A1 | | 1/2003 | |
| WO | WO-03006769 | A1 | * | 1/2003 | ..... E05B 81/66 |

* cited by examiner

HOOD LATCH DEVICE FOR VEHICLE

CROSS-REFERENCE TO RELATED APPLICATION

The present application claims priority to Korean Patent Application No. 10-2018-0018391, filed on Feb. 14, 2018 in the Korean Intellectual Property Office, the entire contents of which is incorporated herein for all purposes by this reference.

BACKGROUND OF THE INVENTION

Field of the Invention

The present invention relates to a hood latch device for a vehicle that is configured for completely closing a hood and of preventing the hood from being undesirably opened.

Description of Related Art

In general, a vehicle is provided at a front portion thereof with an engine compartment and a hood for shielding the engine compartment to protect components mounted in the engine compartment.

The hood is configured to open or close the engine compartment. To this end, there is provided a latch device, which is configured to be locked to or unlocked from a striker provided at the vehicle body. When the hood is not completely closed, it may open unexpectedly and may thus lead to an accident. Furthermore, when the hood is opened while driving, it may block a driver's view.

Furthermore, a typical hood must be pushed down with a large force in order to completely close the engine compartment and lock the hood. However, many physically weak drivers cannot bear the weight of the hood and thus have difficulty closing the hood with a large force, which may frequently result in incomplete closing of the hood.

Furthermore, when it is intended to open the hood, a driver or an operator manipulates an open switch provided in the passenger compartment of the vehicle, and manually releases the locking state of the hood in front of the hood. Accordingly, the hood is not opened with a single manipulation, which decreases convenience of use.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a hood latch device for a vehicle which is configured for securely switching from an incomplete locking state of a hood to a complete locking state.

Various aspects of the present invention are directed to providing a hood latch device for a vehicle that makes it possible to open a hood merely by manipulating a switch provided in the passenger compartment of a vehicle, improving the convenience of use.

In accordance with various aspects of the present invention, the above and other objects may be accomplished by the provision of a hood latch device for a vehicle including a base having therein an insertion recess configured to receive a striker inserted thereinto, a claw lever rotatably mounted to the base, the claw lever being configured to be rotated by the striker inserted into the insertion recess to surround and restrict the striker, a pawl lever rotatably mounted to a portion of the base which is adjacent to the claw lever, the pawl lever being configured to restrict rotation of the claw lever so that the rotational position of the claw lever corresponds to one of a first-stage locking state and a second-stage locking state depending on a contact position with the claw lever, a release lever rotatably mounted to the pawl lever to be rotated with the pawl lever, the release lever being configured to be rotated by the claw lever and to determine a position of the pawl lever depending on a position thereof supported by the base, and an operating mechanism mounted to the base, the operating mechanism including a lever-rotating device configured to be rotated by receiving torque from a driving motor and to selectively rotate one of the claw lever and the pawl lever, wherein when the lever-rotating device rotates the pawl lever, a lock release operation is performed, and when the lever-rotating device rotates the claw lever, a locking operation is performed.

The claw lever may include a latch recess configured to receive the striker inserted thereinto, an extension portion, with which the striker inserted into the insertion recess comes into contact, and a fixing portion protruding in a radial direction further than the extension portion.

The pawl lever may be rotatably mounted at one end portion thereof to the base, may extend such that the opposite end portion thereof is located within the radius of rotation of the lever-rotating device, and may be provided at the middle portion thereof with a latching protrusion which is configured to contact one of the extension portion and the fixing portion of the claw lever.

The hood latch device may further include a fixing bracket mounted to a portion of the base which is opposite to the claw lever on the basis of the pawl lever, the fixing bracket having therein a position-restricting recess formed to receive the release lever inserted thereinto. A position at which the release lever contacts the position-restricting recess varies depending on a position at which the pawl lever contacts the claw lever.

The release lever may be rotatably mounted at the middle portion thereof to the pawl lever, and may be formed such that one end portion thereof extends to be located within the radius of rotation of the lever-rotating device and such that the opposite end portion thereof extends to the position-restricting recess in the fixing bracket.

The opposite end portion of the release lever may be provided with a release pin which is configured to move within the position-restricting recess.

The position-restricting recess may include a curved portion, into which the release lever is inserted so that the pawl lever is located at a position corresponding to the first-stage locking state of the claw lever when the second-stage locking state is switched to the first-stage locking state, and a depressed portion, into which the release lever is inserted so that the pawl lever is located at a position configured for allowing rotation of the claw lever when separation of the striker is performed in the first-stage locking state.

The claw lever may be provided with a cinching pin for rotating the release lever when the claw lever is rotated along with insertion of the striker into the insertion recess.

The release lever may extend to come into contact with the cinching pin of the claw lever when the striker is completely inserted and caught in the insertion recess.

The claw lever may include a cinching extension portion that protrudes to be located within the radius of rotation of the lever-rotating device.

The operating mechanism may further include a gear-rotating device configured to be rotated by receiving torque from the driving motor. The lever-rotating device may extend from the gear-rotating device to be rotated along with the gear-rotating device, and may include a pawl bar located within the radius of rotation of the pawl lever and a latch bar located within the radius of rotation of the claw lever.

The claw lever may be elastically supported by a first elastic member, connected to the base, in the direction in which the striker is separated from the insertion recess.

The pawl lever may be disposed opposite to the claw lever on the basis of the insertion recess, and may be elastically supported by a second elastic member, connected to the base, in the direction in which the striker is separated from the insertion recess. The release lever may be elastically supported by a third elastic member, connected to the pawl lever, in the direction in which the striker is separated from the insertion recess.

The hood latch device may further include a controller configured to control the driving motor. The controller may be configured to determine a second-stage locking state, in which the striker is completely inserted into the insertion recess, a first-stage locking state, in which a portion of the striker is inserted into the insertion recess, or an open state, in which the striker is separated from the insertion recess based on a position of the claw lever or a rotational position of the lever-rotating device, and may control the driving motor based on a determination result.

When the second-stage locking state is switched to the first-stage locking state, the controller may be configured to control the driving motor so that the lever-rotating device pushes the pawl lever and the claw lever is rotated from a position corresponding to the second-stage locking state to a position corresponding to the first-stage locking state, and when the pawl lever is in contact with the claw lever and the first-stage locking state is maintained, the controller may rotate the lever-rotating device in a reverse direction so that the release lever returns to an original position thereof.

When the first-stage locking state is switched to the open state, the controller may be configured to control the driving motor so that the lever-rotating device pushes the pawl lever, restriction of the claw lever is completely released, and the claw lever is rotated to a position corresponding to the open state.

When the open state is switched to the second-stage locking state, the first-stage locking state may be realized such that the claw lever is rotated and is caught by the pawl lever along with insertion of the striker into the insertion recess, and the controller may be configured to control the driving motor so that the lever-rotating device pushes the claw lever and the claw lever is rotated to a position corresponding to the second-stage locking state.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
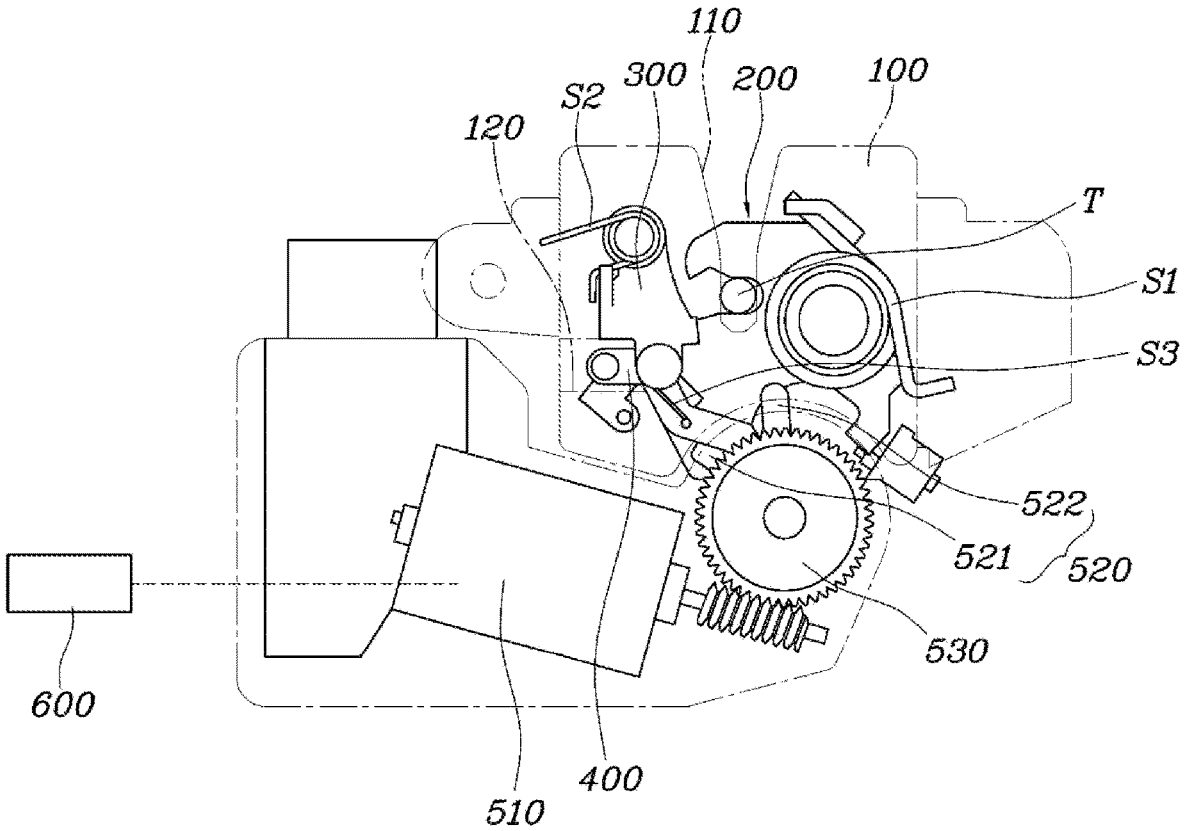
FIG. 1 is a view illustrating a hood latch device for a vehicle according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Reference will now be made in detail to the exemplary embodiments of the present invention, examples of which are illustrated in the accompanying drawings. Wherever possible, the same reference numbers will be used throughout the drawings to refer to the same or like parts.

FIG. 1 is a view illustrating a hood latch device for a vehicle according to an exemplary embodiment of the present invention, and FIG. 2, FIG. 3, FIG. 4, FIG. 5, FIG. 6, FIG. 7, and FIG. 8 are views for explaining the hood latch device for a vehicle depicted in FIG. 1.

Figure 2:
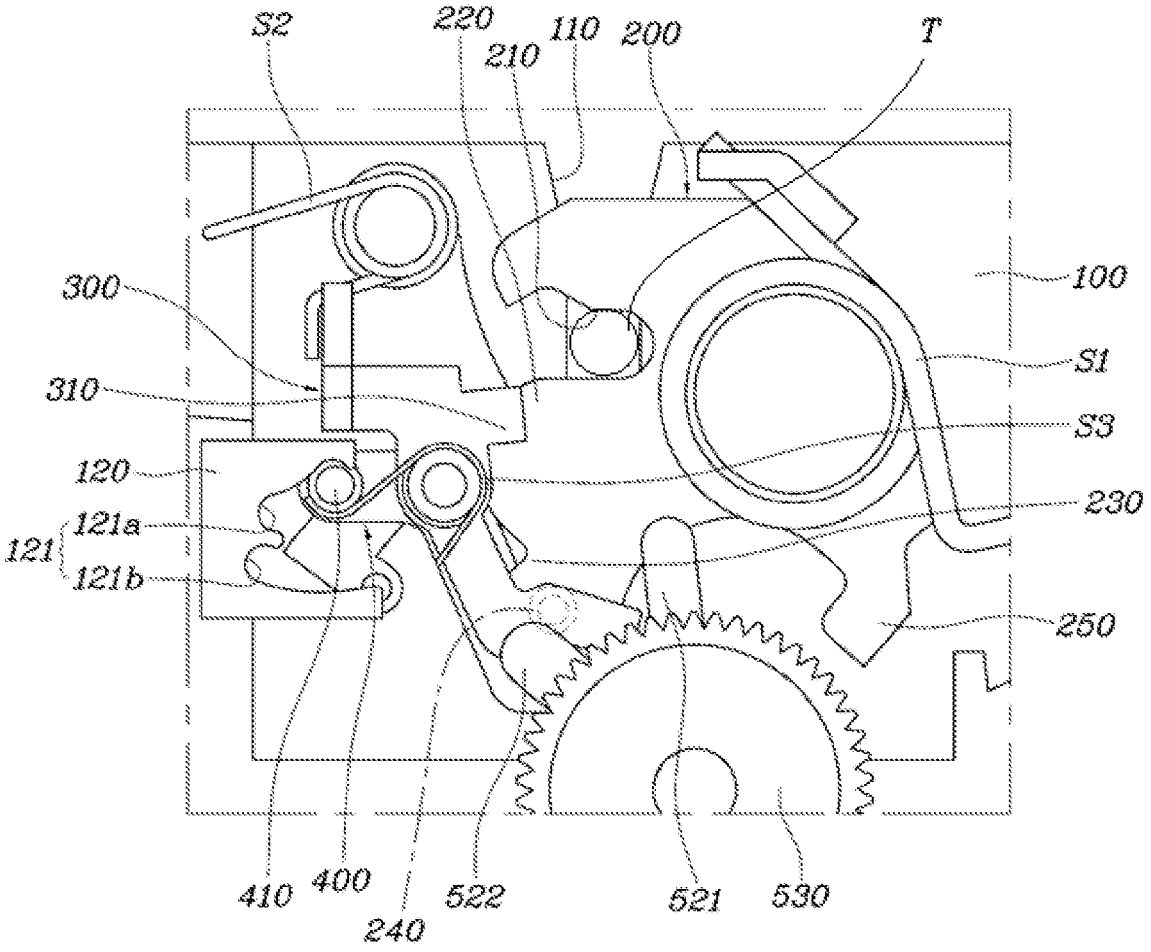
FIG. 2, FIG. 3, FIG. 4, FIG. 5, FIG. 6, FIG. 7, and FIG. 8 are views for explaining the hood latch device for a vehicle depicted in FIG. 1.

The hood latch device for a vehicle according to an exemplary embodiment of the present invention, as shown in FIG. 1, includes a base 100 having therein an insertion recess 110, into which a striker T is inserted, a claw lever 200, which is rotatably mounted to the base 100 and which is configured to be rotated by the striker T inserted into the insertion recess 110 to surround and restrict the striker T, a pawl lever 300, which is rotatably mounted to a portion of the base 100 which is adjacent to the claw lever 200 and which restricts rotation of the claw lever 200 so that the rotational position of the claw lever 200 corresponds to one of multiple locking states depending on the contact position with the claw lever 200, a release lever 400, which is rotatably mounted to the pawl lever 300 to be rotated with the pawl lever 300 and which is rotated by the claw lever 200 and determines the position of the pawl lever 300 depending on the position thereof supported by the base 100, and an operating mechanism, which is mounted to the base 100 and which is provided with a lever-rotating device 520 configured to be rotated by receiving torque from a driving motor 510 and to selectively rotate one of the claw lever 200 and the pawl lever 300. When the lever-rotating device 520 rotates the pawl lever 300, a lock release operation is performed, and when the lever-rotating device 520 rotates the claw lever 200, a locking operation is performed. To assure smooth operation, as shown in FIG. 2, each of the pawl lever 300 and the release lever 400 may be formed such that one end portion and the opposite end portion thereof are bent.

As described above, in an exemplary embodiment of the present invention, the claw lever 200, the pawl lever 300 and the release lever 400 are mounted to the base 100, the claw lever 200 or the pawl lever 300 is selectively rotated by the operating mechanism, and the release lever 400 is rotated interlockingly with rotation of the claw lever 200, performing the locking operation or the lock release operation through restriction of the striker T.

In various aspects of the present invention, second-stage locking may be released merely by manipulating a switch provided in the passenger compartment of the vehicle. In the related art, there is inconvenience in that a driver or an operator manipulates a switch in the passenger compartment to primarily open the hood, and then moves to the hood and secondarily opens the hood. To solve the present problem, the hood latch device for a vehicle according to an exemplary embodiment of the present invention is characterized in that a first-stage locking state and a second-stage locking state may be released at the same time by the operation of the driving motor 510 through manipulation of a switch and in that an incomplete locking state may be securely switched to a complete locking state.

A more detailed description of the present invention will now be made. As shown in FIG. 2, the claw lever 200 may include a latch recess 210, into which the striker T is inserted, an extension portion 220, with which the striker T inserted into the insertion recess 110 comes into contact, and a fixing portion 230, which protrudes in a radial direction further than the extension portion 220. The claw lever 200 is elastically supported by a first elastic member S1, which is connected to the base 100, in the direction in which the striker T is separated from the insertion recess 110. Accordingly, when the striker T is separated from the insertion recess 110, the separation of the striker T may be smoothly realized by the elastic force of the first elastic member S1.

As described above, the claw lever 200 is provided with the latch recess 210, into which the striker T is inserted, and with the extension portion 220, which extends corresponding to the insertion recess 110. Accordingly, when the striker T is inserted into the insertion recess 110, the extension portion 220 may be pushed, the claw lever 200 may be rotated, and consequently the striker T may be moved and inserted into the latch recess 210 along the extension portion 220. Furthermore, since the claw lever 200 is formed such that the extension portion 220 protrudes in the radial direction thereof, the position of the claw lever 200 may be fixed when the extension portion 220 is caught by the pawl lever 300. Furthermore, the rotational position of the claw lever 200 may be determined such that the pawl lever 300 is caught by the extension portion 220 or the fixing portion 230, which protrudes in the radial direction further than the extension portion 220.

To the present end, the pawl lever 300 may be rotatably mounted at one end portion 302 thereof to the base 100, may extend such that the opposite end portion 304 thereof is located within a radius of rotation of the lever-rotating device 520, and may be provided at a middle portion thereof with a latching protrusion 310, which comes into contact with the extension portion 220 or the fixing portion 230 of the claw lever 200. Accordingly, when the pawl lever 300 is rotated on the base 100 by the lever-rotating device 520, the latching protrusion 310 may be caught by the extension portion 220 or the fixing portion 230 of the claw lever 200, and the position of the claw lever 200 may be determined at the corresponding contact position. At the present time, when the latching protrusion 310 of the pawl lever 300 is caught by the extension portion 220, the second-stage locking may be realized, and when the latching protrusion 310 of the pawl lever 300 is caught by the fixing portion 230, the first-stage locking state may be realized.

According to an exemplary embodiment of the present invention, the claw lever 200 is configured to release the multi-stage locking state, namely the first-stage locking state and the second-stage locking state. To the present end, the release lever 400 is mounted to the pawl lever 300, the pawl lever 300 is configured to be rotated by the lever-rotating device 520, and the release lever 400 is configured to be rotated interlockingly with the rotation of the claw lever 200.

That is, when the lever-rotating device 520 rotates the pawl lever 300, the position at which the pawl lever 300 comes into contact with the claw lever 200 is determined depending on the position at which the release lever 400 comes into contact with the base 100, the position at which the release lever 400 comes into contact with the base 100 is changed depending on the rotational position of the claw lever 200, and consequently the radius of rotation within which the lever-rotating device 520 rotates the pawl lever 300 is changed.

As a result, the position of the claw lever 200 is determined depending on the radius of rotation of the pawl lever 300, whereby the locking operation or the lock release operation may be performed.

Described in more detail, as shown in FIGS. 2 to 5, the hood latch device for a vehicle according to an exemplary embodiment of the present invention further includes a fixing bracket 120, which is mounted to a portion of the base 100 which is opposite to the claw lever 200 on the basis of the pawl lever 300 and which has therein a position-restricting recess 121, in which the release lever 400 is inserted and caught.

The release lever 400 may be rotatably mounted at a middle portion thereof to the pawl lever 300, and may be formed such that one end portion 402 thereof extends to be located within a radius of rotation of the lever-rotating device 520 and such that the opposite end portion 404 thereof extends to the position-restricting recess 121 in the fixing bracket 120. The opposite end portion 404 of the release lever 400 is provided with a release pin 410, which is configured to move within the position-restricting recess 121, whereby the opposite end portion 404 of the release lever 400 may be smoothly rotated while being inserted into the position-restricting recess 121. Furthermore, the pawl lever 300 is disposed opposite to the claw lever 200 on the basis of the insertion recess 110, and is elastically supported by a second elastic member S2, which is connected to the base 100, in the direction in which the striker T is separated from the insertion recess 110, and the release lever 400 is elastically supported by a third elastic member S3, which is connected to the pawl lever 300, in the direction in which the striker T is separated from the insertion recess 110, whereby the pawl lever 300 and the release lever 400 can return to the original positions thereof.

That is, when the pawl lever 300 is pushed and rotated by the lever-rotating device 520, the release lever 400 is rotated along with the pawl lever 300, the opposite end portion 404 of the release lever 400, which is inserted into the position-restricting recess 121, is caught in the position-restricting recess 121, and the rotation of the pawl lever 300 is thus restricted, determining the position at which the pawl lever 300 comes into contact with the claw lever 200.

The position-restricting recess 121 may include a curved portion 121*a*, into which the release lever 400 is inserted so that the pawl lever 300 is located at a position corresponding to the first-stage locking state of the claw lever 200 when the second-stage locking state is switched to the first-stage locking state, and a depressed portion 121*b*, into which the release lever 400 is inserted so that the pawl lever 300 is located at a position configured for allowing the rotation of the claw lever 200 when the separation of the striker T is performed in the first-stage locking state.

Accordingly, when the second-stage locking state is switched to the first-stage locking state, the lever-rotating device 520 pushes the pawl lever 300, and the rotation of the claw lever 200 is thus allowed, whereas the opposite end portion 404 of the release lever 400 is inserted into the curved portion 121*a* of the position-restricting recess 121 and the movement thereof is restricted, whereby the pawl lever 300 is located at a position corresponding to the first-stage locking state of the claw lever 200. Consequently, the claw lever 200 is allowed to be switched to the first-stage locking state.

When the claw lever 200 is rotated to correspond to the first-stage locking state, the rotation of the release lever 400 is allowed, and the release lever 400 is maintained in the state of being separated from the curved portion 121*a*. When the separation of the striker T is performed in the first-stage locking state, the lever-rotating device 520 pushes the pawl lever 300, and the opposite end portion 404 of the release lever 400 is thus inserted into the depressed portion 121*b* in the position-restricting recess 121, whereby the radius of rotation of the pawl lever 300, which is rotated by the lever-rotating device 520, is increased. Accordingly, the pawl lever 300 is located at a position configured for avoiding interference with the claw lever 200, whereby the claw lever 200 may be rotated to be completely separated from the striker T.

The curved portion 121*a* and the depressed portion 121*b* in the position-restricting recess 121 may be formed to have different depths from each other so that the radius of rotation of the pawl lever 300 varies when the opposite end portion 404 of the release lever 400 is inserted into the curved portion 121*a* or the depressed portion 121*b*. For example, the depth of the depressed portion 121*b* may be greater than the depth of the curved portion 121*a*. Accordingly, depending on the variation in the rotational position of the release lever 400, the rotational position of the pawl lever 300 and the rotational position of the claw lever 100 may be changed.

The claw lever 200 may be provided with a cinching pin 240 for rotating the release lever 400 when the claw lever 200 is rotated along with the insertion of the striker T into the insertion recess 110.

Therefore, it is desirable for the release lever 400 to have a length that allows the release lever 400 to come into contact with the cinching pin 240 of the claw lever 200 when the striker T is completely inserted and caught in the insertion recess 110 and that allows the release lever 400 to deviate from the radius of rotation of the lever-rotating device 520 when the release lever 400 is rotated by the third elastic member S3.

When the claw lever 200 is located at a position corresponding to the complete insertion of the striker T into the insertion recess 110, the rotational position of the release lever 400 is located within the radius of rotation of the lever-rotating device 520 by the cinching pin 240.

That is, as shown in FIG. 2, in the second-stage locking state, in which the striker T is completely inserted into the insertion recess 110, the release lever 400 may be located within the radius of rotation of the lever-rotating device 520 to perform the lock release operation. Because the release lever 400 is elastically supported by the third elastic member S3, the release lever 400 is urged to return to the original position thereof, and may thus deviate from the radius of rotation of the lever-rotating device 520. However, the release lever 400 is located within the radius of rotation of the lever-rotating device 520 by the cinching pin 240 provided at the claw lever 200.

Furthermore, in the open state, in which the striker T is completely separated from the insertion recess 110, when the striker T is inserted into the insertion recess 110, the cinching pin 240 provided at the claw lever 200 pushes and rotates the release lever 400, whereby the pawl lever 300 is moved and is brought into contact with the claw lever 200, and the release lever 400 is moved to a position corresponding to a standby state for a subsequent lock release operation.

Furthermore, the claw lever 200 may include a cinching extension portion 250, which protrudes to be located within the radius of rotation of the lever-rotating device 520.

When the claw lever 200 is switched from the first-stage locking state to the second-stage locking state, the cinching extension portion 250 is rotated interlockingly with the lever-rotating device 520. When the lever-rotating device 520 is rotated in the locking direction and pushes the cinching extension portion 250, the claw lever 200 is rotated further in the direction in which the striker T is restricted, whereby the cinching operation is performed.

The operating mechanism may include a gear-rotating device 530, which is rotated by receiving torque from the driving motor 510, and the lever-rotating device 520, which extends from the gear-rotating device 530 and is configured to be rotated along with the gear-rotating device 530. The lever-rotating device 520 may include a pawl bar 521, which is located within the radius of rotation of the pawl lever 300, and a latch bar 522, which is located within the radius of rotation of the claw lever 200.

Accordingly, the operating mechanism includes the driving motor 510, the gear-rotating device 530, and the lever-rotating device 520, and the lever-rotating device 520 includes the pawl bar 521 for rotating the pawl lever 300 and the latch bar 522 for rotating the claw lever 200. The gear-rotating device 530, which is rotatably mounted to the base 100, is rotated by receiving torque from the driving motor 510. When the pawl bar 521 rotates the release lever 400 due to the rotation of the gear-rotating device 530, the locking state is released. When the latch bar 522 rotates the claw lever 200 due to the rotation of the gear-rotating device 530, the cinching operation for switching from the lock release state to the locking state is performed.

The locking operation and the lock release operation are performed respectively by the latch bar 522 and the pawl bar 521, which form the lever-rotating device 520. To realize each operation independently, it is desirable for the pawl bar 521 and the latch bar 522 to be formed at different heights from each other.

Hereinafter, the hood latch device for a vehicle according to an exemplary embodiment of the present invention will be described in more detail. The driving motor 510 may be operated under the control of a controller 600. The controller 600 may determine the second-stage locking state, in which the striker T is completely inserted into the insertion recess 110, the first-stage locking state, in which a portion of the striker T is inserted into the insertion recess 110, or the open state, in which the striker T is separated from the insertion recess 110 based on the position of the claw lever 200 or the rotational position of the lever-rotating device 520, and may control the driving motor 510 based on the determination result.

The process of separating the striker T from the insertion recess 110 will now be described. When the second-stage locking state is switched to the first-stage locking state, the controller 600 controls the driving motor 510 so that the lever-rotating device 520 pushes the pawl lever 300 and the claw lever 200 is therefore allowed to be rotated from the position corresponding to the second-stage locking state to the position corresponding to the first-stage locking state.

That is, as shown in FIG. 2, in the second-stage locking state, the striker T is completely inserted into the insertion recess 110, the claw lever 200 surrounds the striker T and restricts the movement of the striker T, the latching protrusion 310 of the pawl lever 300 is caught by the extension portion 220 of the claw lever 200, and the one end portion 402 of the release lever 400 is in contact with the cinching pin 240 of the claw lever 200. At the present time, the opposite end portion 404 of the release lever 400 is inserted into the position-restricting recess 121 in the fixing bracket 120, which is mounted to the base 100. As shown in FIG. 2, the opposite end portion 404 of the release lever 400 is caught in the upper portion of the position-restricting recess 121.

Figure 3:
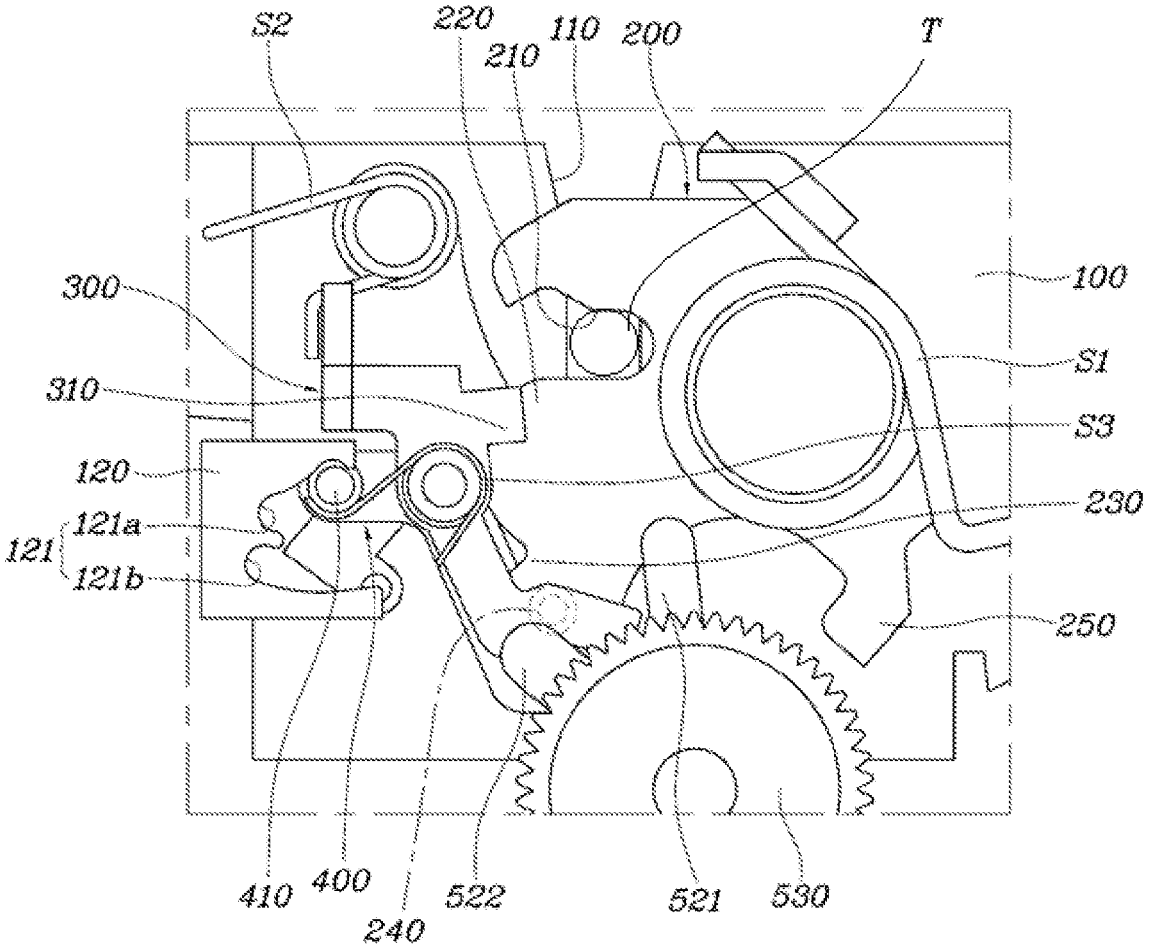

When the present second-stage locking state is switched to the first-stage locking state, as shown in FIG. 3, the gear-rotating device 530 is rotated by the driving motor 510, and thus the pawl bar 521 of the lever-rotating device 520 pushes and rotates the pawl lever 300. At the present time, the pawl lever 300 is separated from the extension portion 220 of the claw lever 200, and the opposite end portion 404 of the release lever 400 is inserted into the curved portion 121*a* of the position-restricting recess 121 in the fixing bracket 120. Accordingly, the rotation of the pawl lever 300 is restricted, and the latching protrusion 310 of the pawl lever 300 is located at a position corresponding to the fixing portion 230 of the claw lever 200.

Figure 4:
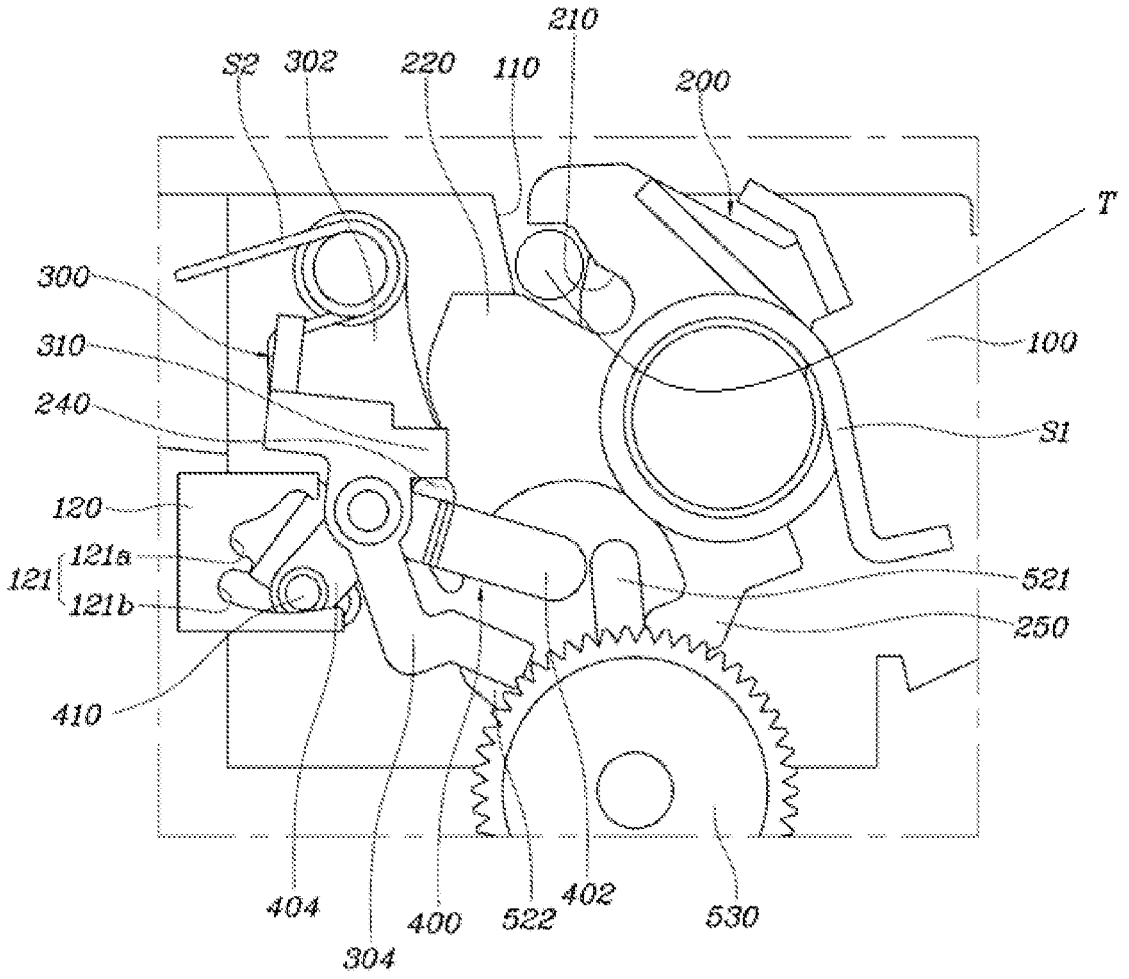

Subsequently, the claw lever 200 is rotated by the first elastic member S1, and the fixing portion 230 is caught by the latching protrusion 310 of the pawl lever 300, whereby the rotational position of the claw lever 200 is fixed. As shown in FIG. 4, the cinching pin 240 is moved by the rotation of the claw lever 200, thus allowing rotation of the release lever 400, whereby the release lever 400 is separated from the curved portion 121*a*. At the present time, the release lever 400 is rotated by the third elastic member S3, and the opposite end portion 404 of the release lever 400 is therefore located at a position corresponding to the depressed portion 121*b* of the position-restricting recess 121. Furthermore, since the middle portion of the release lever 400 is formed to be bent, when the claw lever 200 is rotated, the cinching pin 240 can pass by the middle portion of the release lever 400.

To get ready for switching from the first-stage locking state to the open state, the controller 600 controls the driving motor 510 so that the gear-rotating device 530 is rotated in the reverse direction thereof.

Figure 5:
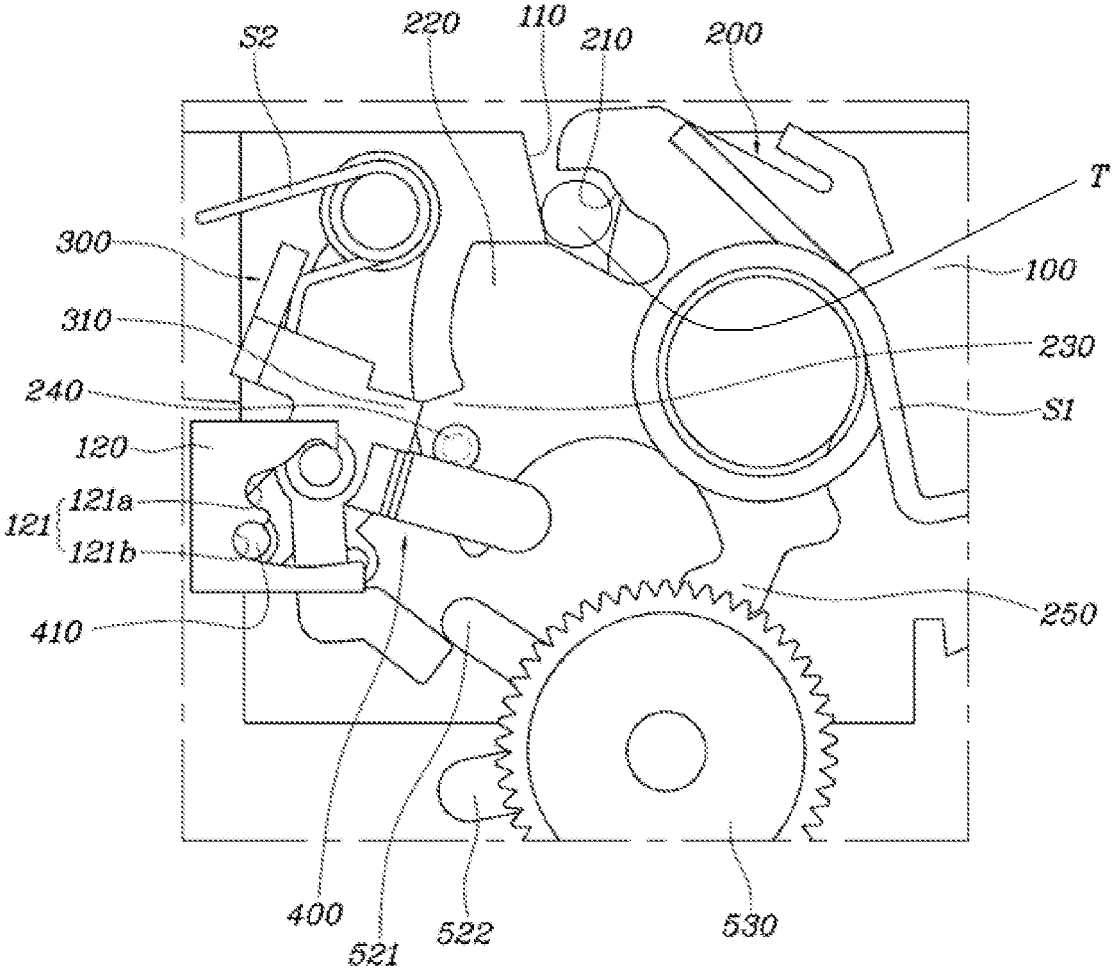

Subsequently, when the first-stage locking state is switched to the open state, in which the striker T is separated from the insertion recess 110, the controller 600 controls the driving motor 510 so that the pawl bar 521 of the lever-rotating device 520 is rotated. At the present time, as shown in FIG. 5, when the pawl bar 521 of the lever-rotating device 520 pushes and rotates the pawl lever 300, the opposite end portion 404 of the release lever 400 is inserted into the depressed portion 121*b* of the position-restricting recess 121.

Figure 6:
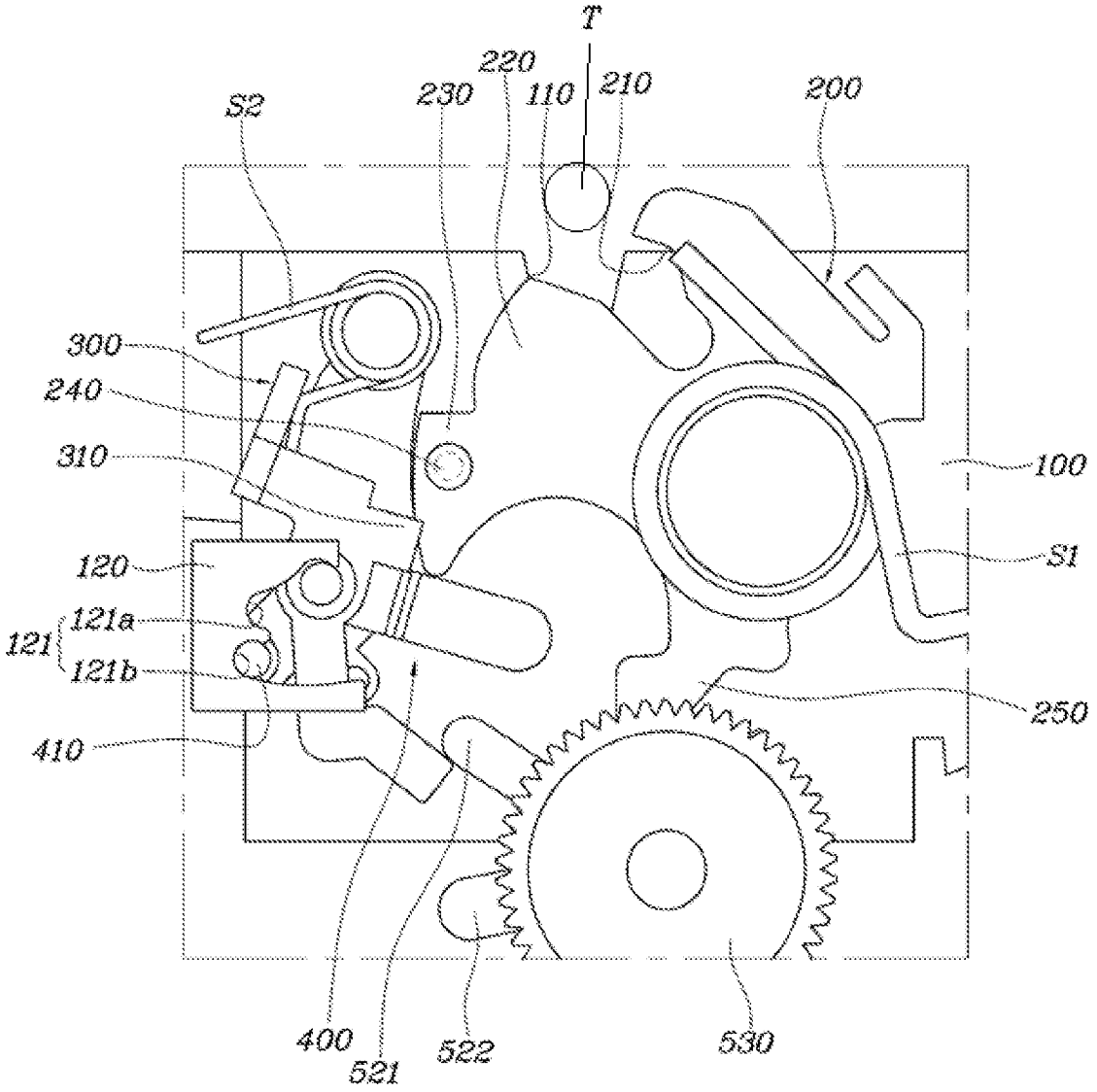

Accordingly, the radius of rotation of the pawl lever 300, which is rotated by the pawl bar 521, is secured. As shown in FIG. 6, the pawl lever 300, which is rotated by the pawl bar 521, is located at a position configured for avoiding interference with the claw lever 200. Accordingly, the claw lever 200 is rotated to a position corresponding to the open state by the elastic force of the first elastic member S1, and consequently the striker T is separated from the claw lever 200.

Figure 7:
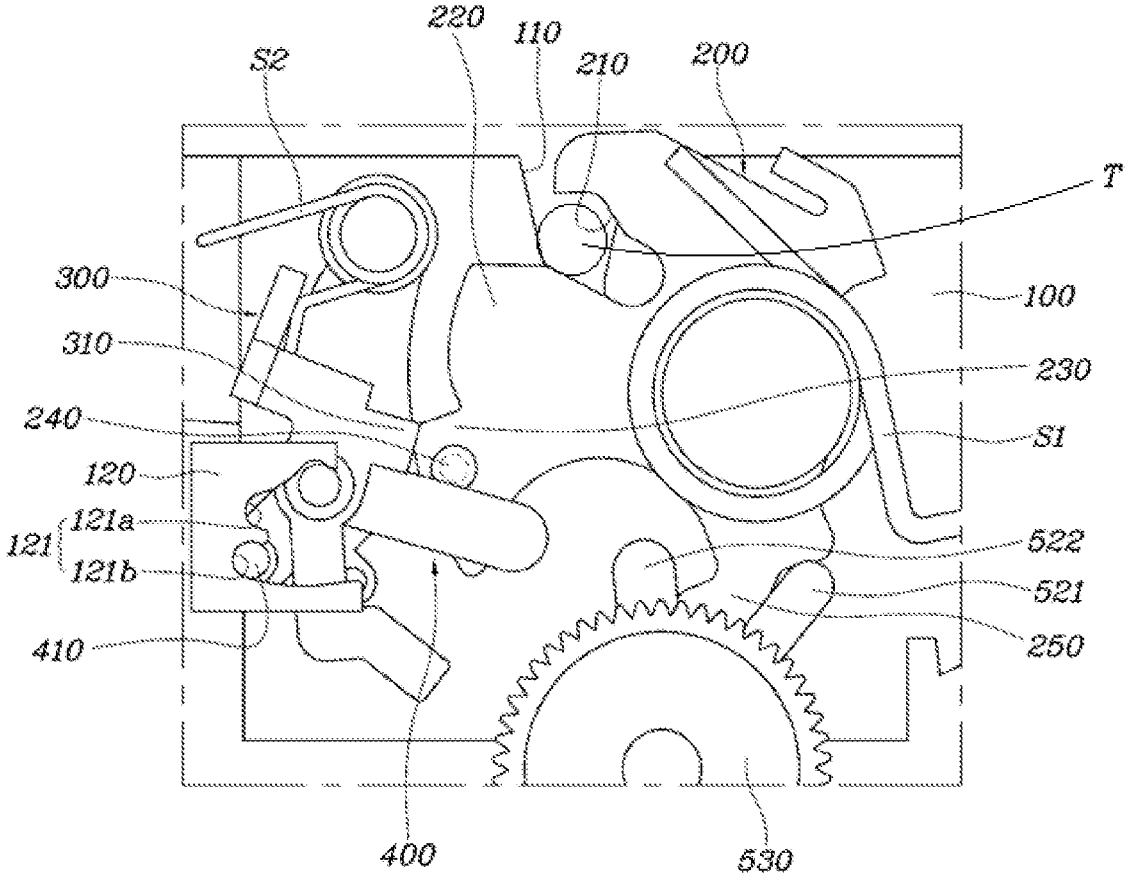

The process of inserting the striker T into the insertion recess 110 will now be described. When the open state is switched to the second-stage locking state, as shown in FIG. 7, the controller 600 performs control to realize the first-stage locking state, in which the claw lever 200 is rotated and is caught by the pawl lever 300 by the insertion of the striker T into the insertion recess 110.

Figure 8:
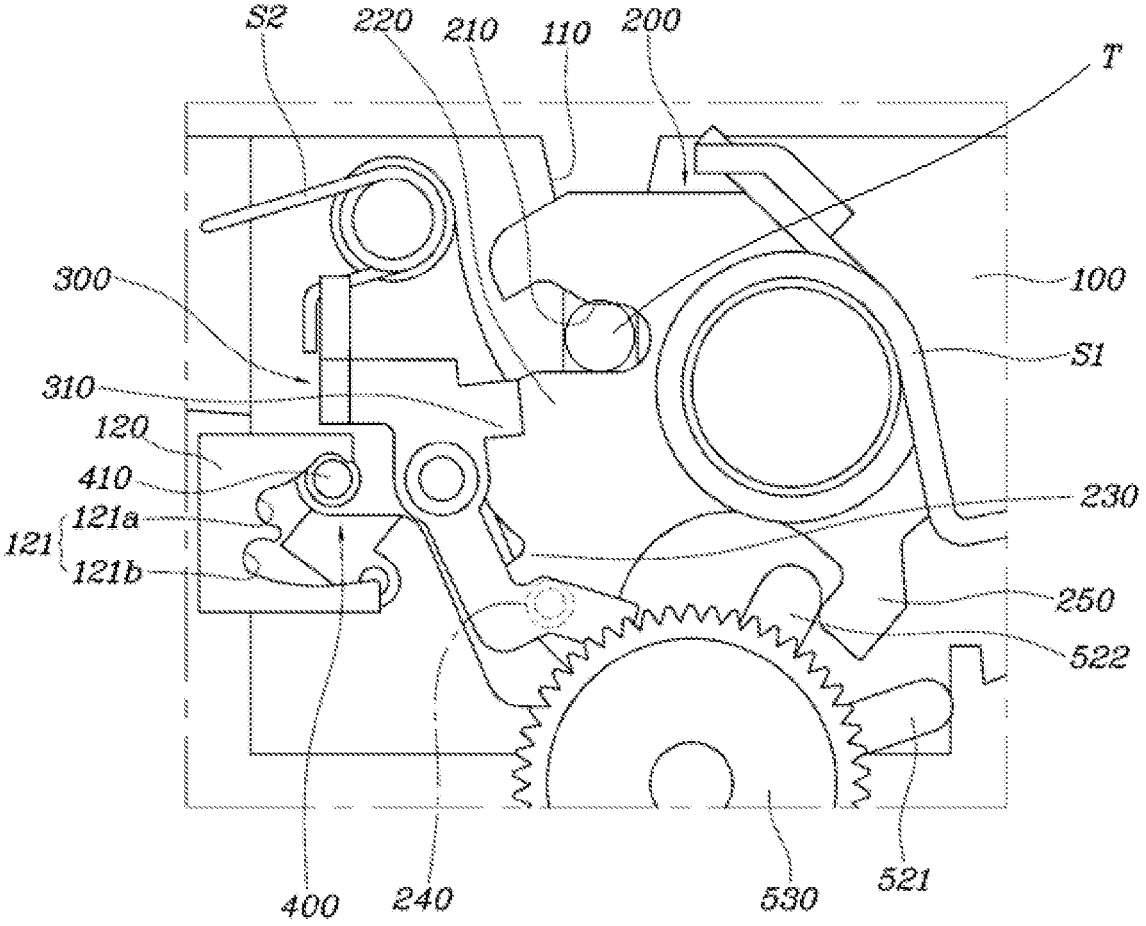

In the present state, as shown in FIG. 8, the controller 600 controls the driving motor 510 so that the latch bar 522 of the lever-rotating device 520 pushes and rotates the cinching extension portion 250 of the claw lever 200. As a result of the rotation of the claw lever 200, the claw lever 200 is located at a position at which the latching protrusion 310 of the pawl lever 300 is caught by the fixing portion 230 of the claw lever 200. Subsequently, the pawl lever 300 is moved by the second elastic member S2, and the latching protrusion 310 of the pawl lever 300 is caught by the fixing portion 230 of the claw lever 200. The opposite end portion 404 of the release lever 400 is separated from the depressed portion 121*b* of the position-restricting recess 121, and accordingly, the release lever 400 is rotated by the cinching pin 240 of the claw lever 200.

The claw lever 200 is rotated so that the striker T is surrounded by the latch recess 210 of the claw lever 200. As the latch bar 522 of the lever-rotating device 520 rotates the claw lever 200, the striker T is completely inserted into the insertion recess 110. As a result, the cinching operation for the second-stage locking state is completed.

As is apparent from the above description, various aspects of the present invention are directed to providing a hood latch device for a vehicle which is configured for improving stability by securely switching from an incomplete locking state of a hood to a complete locking state.

Furthermore, it is possible to open a hood merely by manipulating a switch provided in the passenger compartment of a vehicle, improving the convenience of use.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A hood latch device for a vehicle, the hood latch device comprising:

a base having an insertion recess to receive a striker inserted thereinto;

a claw lever rotatably mounted to the base, the claw lever to be rotated by the striker inserted into the insertion recess to surround and restrict the striker;

a pawl lever rotatably mounted to a portion of the base which is adjacent to the claw lever, the pawl lever being configured to restrict a rotation of the claw lever so that a rotational position of the claw lever corresponds to one of a first-stage locking state and a second-stage locking state depending on a contact position with the claw lever;

a release lever rotatably mounted to the pawl lever to be rotated with the pawl lever, the release lever being configured to be rotated by the claw lever and to change a position of the pawl lever depending on a position of the claw lever supported by the base; and an operating mechanism mounted to the base, the operating mechanism including a lever-rotating device coupled to a driving motor and configured to be rotated by receiving torque from the driving motor and to selectively rotate one of the claw lever and the pawl lever, wherein, when the lever-rotating device rotates the pawl lever, a lock release operation of the hood latch device is performed, and when the lever-rotating device rotates the claw lever, a locking operation of the hood latch device is performed, and wherein the claw lever is provided with a cinching pin for rotating the release lever when the claw lever is rotated along with insertion of the striker into the insertion recess.

2. The hood latch device according to claim 1, wherein the claw lever includes:

a latch recess to receive the striker inserted thereinto;

an extension portion, with which the striker inserted into the insertion recess contacts; and a fixing portion protruding in a radial direction of the claw lever further than the extension portion.

3. The hood latch device according to claim 2, wherein the pawl lever is rotatably mounted at a first end portion thereof to the base, extends such that a second end portion thereof is located within a radius of a rotation of the lever-rotating device, and is provided at a middle portion thereof with a latching protrusion to selectively contact one of the extension portion and the fixing portion of the claw lever.

4. The hood latch device according to claim 1, further including:

a fixing bracket mounted to a portion of the base, wherein the fixing bracket is located opposite to the claw lever on a basis of the pawl lever, the fixing bracket having therein a position-restricting recess formed to receive the release lever inserted thereinto, wherein a position at which the release lever contacts the position-restricting recess varies depending on a position at which the pawl lever contacts the claw lever.

5. The hood latch device according to claim 4, wherein the release lever is rotatably mounted at a middle portion thereof to the pawl lever, and includes:

a first end portion extending to be located within a radius of a rotation of the lever-rotating device; and a second end portion extending to the position-restricting recess in the fixing bracket.

6. The hood latch device according to claim 5, wherein the second end portion of the release lever is provided with a release pin moving within the position-restricting recess.

7. The hood latch device according to claim 5, wherein the position-restricting recess includes:

a curved portion, into which the second end portion of the release lever is inserted so that the pawl lever is located at a position corresponding to the first-stage locking state of the claw lever when the second-stage locking state is switched to the first-stage locking state; and a depressed portion, into which the second end portion of the release lever is inserted so that the pawl lever is located at a position allowing a rotation of the claw lever when separation of the striker is performed in the first-stage locking state.

8. The hood latch device according to claim 1, wherein a portion of the release lever is protrudingly formed to contact with the cinching pin of the claw lever when the striker is inserted and caught in the insertion recess.

9. The hood latch device according to claim 1, wherein the claw lever includes a cinching extension portion that is protrudingly formed to be located within a radius of a rotation of the lever-rotating device.

10. The hood latch device according to claim 1, wherein the operating mechanism further includes a gear-rotating device engaged with the driving motor to be rotated by receiving torque from the driving motor, and wherein the lever-rotating device is protrudingly formed from the gear-rotating device to be rotated along with the gear-rotating device, and includes:

a pawl bar located within a radius of a rotation of the pawl lever; and a latch bar located within a radius of a rotation of the claw lever.

11. The hood latch device according to claim 1, wherein the claw lever is elastically supported by a first elastic member, connected to the base.

12. The hood latch device according to claim 1, wherein the pawl lever is disposed opposite to the claw lever on a basis of the insertion recess, and is elastically supported by a second elastic member, connected to the base, and wherein the release lever is elastically supported by a third elastic member, connected to the pawl lever.

13. The hood latch device according to claim 1, further including:

a controller configured to control the driving motor, wherein the controller is configured to determine the second-stage locking state, in which the striker is completely inserted into the insertion recess, the first-stage locking state, in which a portion of the striker is inserted into the insertion recess, or an open state, in which the striker is separated from the insertion recess based on a position of the claw lever or a rotational position of the lever-rotating device, and is configured to control the driving motor based on a determination result.

14. The hood latch device according to claim 13, wherein, when the second-stage locking state is switched to the first-stage locking state, the controller is configured to control the driving motor so that the lever-rotating device rotates in a first direction to push the pawl lever and the claw lever is rotated from a position corresponding to the second-stage locking state to a position corresponding to the first-stage locking state, and wherein, when the pawl lever is in contact with the claw lever and the first-stage locking state is maintained, the controller is configured to rotate the lever-rotating device in a second direction which is reverse to the first direction so that the release lever returns to an original position thereof.

15. The hood latch device according to claim 14, wherein, when the first-stage locking state is switched to the open state, the controller is configured to control the driving motor so that the lever-rotating device pushes the pawl lever, restriction of the claw lever is completely released, and the claw lever is rotated to a position corresponding to the open state.

16. The hood latch device according to claim 13, wherein, when the open state is switched to the second-stage locking state, the first-stage locking state is realized such that the claw lever is rotated and is caught by the pawl lever with insertion of the striker into the insertion recess, and the controller is configured to control the driving motor so that the lever-rotating device pushes the claw lever and the claw lever is rotated to a position corresponding to the second-stage locking state.

* * * * *